US007380322B2

(12) United States Patent
von Detten

(10) Patent No.: US 7,380,322 B2
(45) Date of Patent: Jun. 3, 2008

(54) DEVICE FOR INSERTION OF CONTACTS INTO CONNECTOR INSULATOR CAVITIES

(76) Inventor: Volker von Detten, 535 E. Walnut Ave., Apt. A, El Segundo, CA (US) 90245

( * ) Notice: Subject to any disclaimer, the term of this patent is extended or adjusted under 35 U.S.C. 154(b) by 0 days.

(21) Appl. No.: 11/638,014

(22) Filed: Dec. 13, 2006

(65) Prior Publication Data

US 2008/0020629 A1 Jan. 24, 2008

Related U.S. Application Data

(60) Provisional application No. 60/750,021, filed on Dec. 13, 2005.

(51) Int. Cl.
*H01R 43/00* (2006.01)

(52) U.S. Cl. ..... 29/33 M; 29/842; 439/488

(58) Field of Classification Search ..... 439/488, 439/877, 879; 29/842, 33 R, 33 M
See application file for complete search history.

(56) References Cited

U.S. PATENT DOCUMENTS 4,932,110 A * 6/1990 Tanaka ..... 29/33 M
5,159,749 A 11/1992 Weigert
5,471,741 A * 12/1995 Heisner et al. ..... 29/857
5,590,676 A 1/1997 Wagner
5,933,932 A 8/1999 Watanabe

* cited by examiner

*Primary Examiner*—Khiem Nguyen

(57) ABSTRACT

A contact insertion device comprises an arrangement of elements the like of independent linear multi axis actuator providing positioning and fixation for electrical connection element and cylindrical elongated electrical conductor article having a wire electrically attached to one end with opposite end being positioned in collinear fashion adjacent to an insulator cavity preselected by computer controlled enunciation and installed manually into pre selected cavity of electrical connection element. An independent linear actuator provides a test element connected to an enunciation element for verification of error free installation of conductor article into electrical connection element. Aforesaid independent actuators are being initiated by a controller having a computer assigned that is driven by an algorithm and feed back system capable of programmed selection for positioning and verification of non error completion for installation of electrical conductor article.

16 Claims, 13 Drawing Sheets

DEVICE FOR INSERTION OF CONTACTS INTO CONNECTOR INSULATOR CAVITIES

RELATED APPLICATIONS

This application claims the priority date of prior filed applications having Ser. No. 60/750,021 and filing date of Dec. 13, 2005 and entitled: Device for Insertion of Contacts into Connector Insulator Cavities.

INCORPORATION BY REFERENCE

Applicant(s) herein incorporate by reference, any and all U.S. patents and U.S. patent applications cited or referred to in this application.

FIELD OF INVENTION

This invention relates generally to contact assembly into connector in particular to a contact insertion device including the arrangement of elements to provide independent linear actuators in multi axis to automatically position an insulator of a connector to an enunciation apparatus for a contact about to be inserted into visually identified cavity of insulator. A test pin will automatically verify that the contact has been inserted into the correct and for this contact designated insulator cavity.

BACKGROUND

Connectors are usually the termination elements of a cable and harness. Harnesses are a combination of cables bundled together with their end points or connectors interconnecting with other connectors for the purpose to transmit electric current or signals to respective elements such as power supplies, computers, control instrumentation and the like. Harnesses are used in many different applications ranging from airplanes, automobiles, televisions, machinery and the like. Harnesses can be very small but also very extensive in size and number of connectors. A common connector comprises a shell encircling an insulator thereof equipped with numerous contacts inserted and locked into. Aforesaid contacts are permanently connected with a wire that is conducting electric current. The connection with the contact can be a crimped connection or a soldered connection depending on the application the harness is being used for. Each connector can carry a small number of contacts but usually carries an extensive number of contacts confined within a single insulator. Consequential aforesaid necessitates a very small distance of each individual contact from each other within the periphery of a single insulator. Aforesaid is expressed in common terms as of high density. High density in connecting devices has become the norm as it is very desirable to achieve a compact or smallest in size design of applicable devices for the purpose to reduce cost and promote efficiency in terms of optimum performance. The common method for inserting contacts permanently attached to a wire is by manual method. This comprises an elaborate and very skillful process involving a trained assembler carefully comparing cavity location with contact identification in a connector for inserting carefully the contact into a designated location. Foresaid process is cumbersome and of low reliability meaning that each individual contact has been inserted in its designated cavity of insulator without error. Error recovery comprises a costly repair process. There can be up to 60 cavities over the area equivalent to one square inch with each cavity designated to a specific contact in a high-density connector. Said high density necessitates an elaborate and time-consuming verification process after the final insertion of contact into the cavity of insulator. It is well known that the cost to manufacture harnesses comprises a major portion of the total cost to manufacture specific equipment. Aforesaid especially is of significance for avionics such as airplanes and the like. An automated post verification process will greatly reduce the time element for completion of contact assembly and additionally will negate the need for highly skilled assembly technicians and guarantee zero defects hence a very costly repair process.

DESCRIPTION OF RELATED ART

The following art describes the present state of this field:

There are numerous US patents describing the making and assembly of electrical harnesses including automated feeding of contacts to the insertion process into cavities of connector insulator and automated routing of wires and automated stripping of wire insulation prior to the automated crimping of bare wire termination with contact. U.S. Pat. No. 5,590,576 describes the feed mechanism for connectors to be assembled with contacts whereas the wires terminations are crimped with contact crimp barrel either prior contact insertion or after contact insertion. Connectors are of many different sizes and carry contacts of much different size, numbers in many different array or layout arrangement of insulator. It is common to find in especially high density connectors that each individual cavity within one layout has each contact assigned to a particular cavity which commonly is identified by a number silk screened onto surface of insulator immediately adjacent to the specific cavity location. A color code on wire is assigned to a specific cavity location hence number, which has to be verified, searched for prior to the contact insertion process. Referenced patent above fails to teach a method which includes aforesaid in its specifications. U.S. Pat. No. 5,933,932 describes an apparatus for making electrical harness including a wire harness transport assembly. Said patent does not teach the automated location of cavity in insulator with matching contact color code including an automated test for verification of correct contact to cavity match. U.S. Pat. No. 5,159,749 discloses a harness making machine to process the wires to a desirable array of fixed and spaced wires, such as the wires can be further processed into harnesses the like of wires are placed into crimping machines to electrically connect the wires with the electrical connector. Aforesaid process does not teach selective assignment of electrical wire connection to electrical connector and insulator cavity respectively which is essential to many multi purpose and high density connectors to enable to transmit many various current, voltage and signals within a single connector. Within the periphery of said connector there may be terminating a large number of wires with each wire assigned to a discrete termination element thereof required to perform a specific function.

SUMMARY OF INVENTION

The present invention teaches certain benefits in construction and use, which give rise to the objectives described below.

In the preferred embodiment of the invention, then the contact insertion device comprises an arrangement of elements the like of independent linear multi axis actuator providing positioning and fixation for electrical connection element and cylindrical elongated electrical conductor article having a wire electrically attached to one end with opposite end being positioned in collinear fashion adjacent to an insulator cavity preselected by computer controlled enunciation and mated manually to pre selected cavity of electrical connection element. A further independent linear actuator provides a test element connected to an enunciation element for verification of error free mating of conductor article to electrical connection element. Aforesaid independent actuators are being initiated by a controller having a computer assigned that is driven by an algorithm and feed back system capable of selective positioning thereof and verification of non error completion of mating process.

A primary objective of one embodiment of the present invention is to provide an apparatus and method of use of such apparatus that yields advantages not taught by the prior art.

It is an objective of the invention then to design a contact insertion apparatus, which will selectively and automatically match contacts with the appropriate cavity within the insulator of an electrical connector.

A still further objective is to assure that an embodiment of the invention is to provide an adapter for universal and quick location of electric connection elements having various layouts for electric conducting articles to be mated.

A still further objective is to assure that an embodiment of the invention is to provide an adapter for universal and quick location of electric connection elements having various clocking positions in relation to layout for electric conducting articles to be mated.

A still further objective is to assure that an embodiment of the invention is to provide an automated enunciation and diagnostics capability for error recovery immediately at post insertion.

A still further objective is to assure that an embodiment of the invention is to provide the testing of electric conducting article with a test probe automatically.

A still further objective is to assure that an embodiment of the invention is capable to adjust the test probe automatically to provide proper electric conductance with electric conducting article to the various height in horizontal plane of electric connection element for referencing and verification.

A still further objective is to assure that an embodiment of the invention is capable to process certain input information into processor with the objective to quickly and automatically match electric connection element with proper electric conducting article.

A still further objective is to assure that an embodiment of the invention is conceived to present advantages over other inventions for a contact insertion apparatus with one advantage providing the ability to readily change a preferred configuration to another preferred configuration done and completed by the end user of this invention.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

Figure 1:
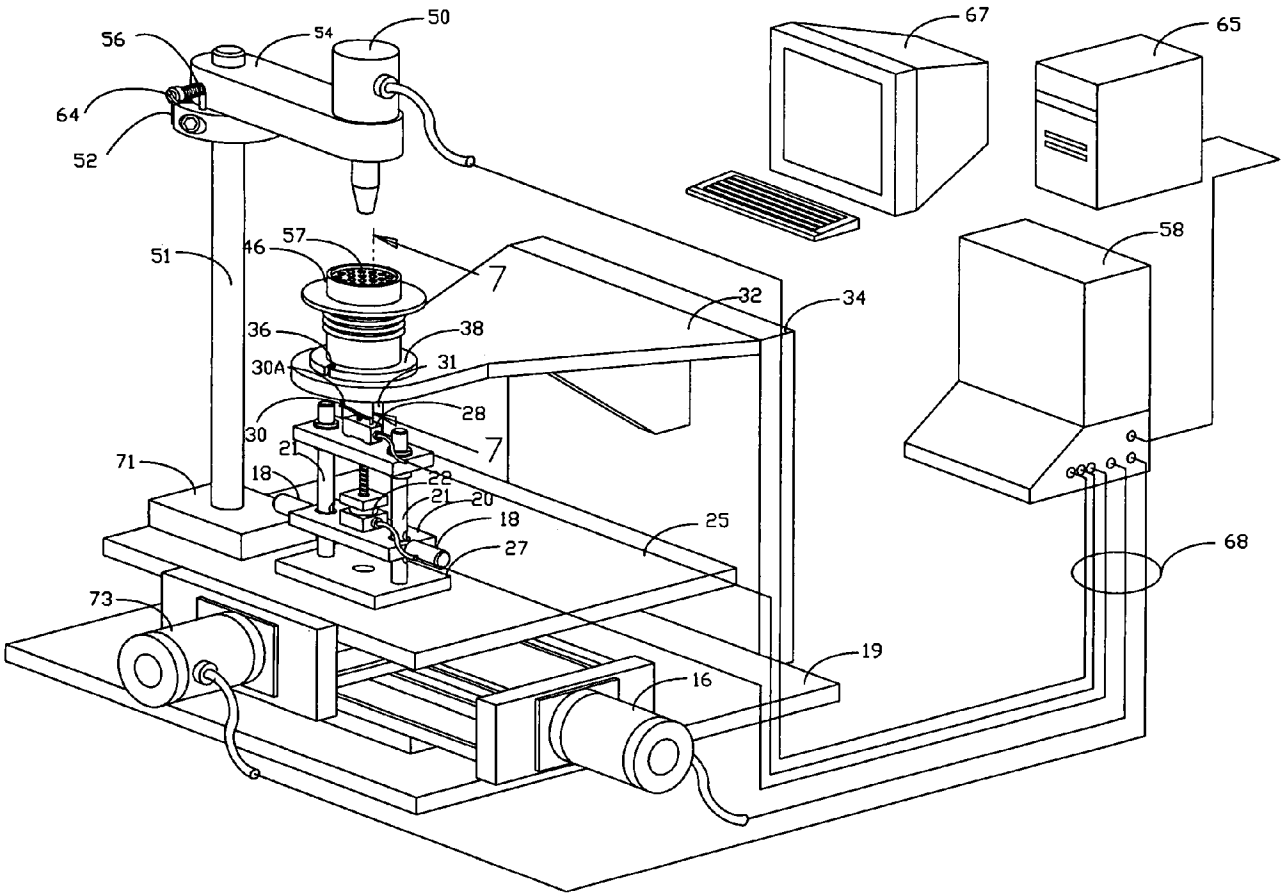
FIG. 1 is a perspective view of a preferred embodiment of present invention of a contact insertion and testing device.

FIG. 1 shows female connector 46 with assembled insulator 57 mounted into clocking insert 38 and mounting bracket 32, which is fastened onto upright 34. Locator pin 36 warrants proper clocking of insert 38. Below mounting bracket 32 is 2 axes horizontal positioning table 19 thereof easily to be obtained in commerce. Stepper or servomotor 16 moves the mounting table 25 in the x-axis linear direction and stepper or servomotor 73 moves the mounting table 25 in a y-axis linear direction. Motor 73 and 16 respectively is connected to controller 58 with plurality of line 68 enabling motor 73 and 16 respectively to position mounting table 25 in various positions within the boundary or work envelope maximized due to travel length for x and y axis respectively. The pre selected or preprogrammed positions as a function of x-axis value and y-axis value or coordinates are limited in number by the resolution or minimum increments per each individual coordinate. Dwell time per position is programmable or event driven. Upper extremity of mounting table 25 is having base plate 27 and platform 20. Base plate 27 supports vertically mounted plurality of bar 21. Platform 20 straddles plurality of bar 21 and slides along the vertical plane in reciprocating fashion. Servo or stepper motor 22 is mounted on platform 20 and connected to controller 58 with plurality of line 68 enabling motor 22 to position mounting plate 23 in various position along z axis. Plurality of linear bearing 26 straddling plurality of bar 21 is providing precision movement of mounting plate 23. Limit switch 28 is fixated on mounting plate 23 as such that wiper arm 30A of micro switch 28 is below of and collinear with test pin 30. Limit switch 28 is connected with controller 58 via plurality of line 68. Test pin 30 is held in vertical plane by fixture 31. Base plate 71 supports upright column 17 having adjustment clamp 52. Laser beam generator 50 is held in a permanent position coaxial with test pin 30 by swivel bracket 54, placed atop of clamp 52. Setscrew 64 holds swivel bracket 54 in position setting against stop pin 56. If necessary a laser beam generated by generator 50 thereof controlled by controller 65 is able to illuminate cavity positions of insulator 57. Aforesaid is the enunciation required for an operator to insert contact 57 into the cavity illuminated.

Figure 2:
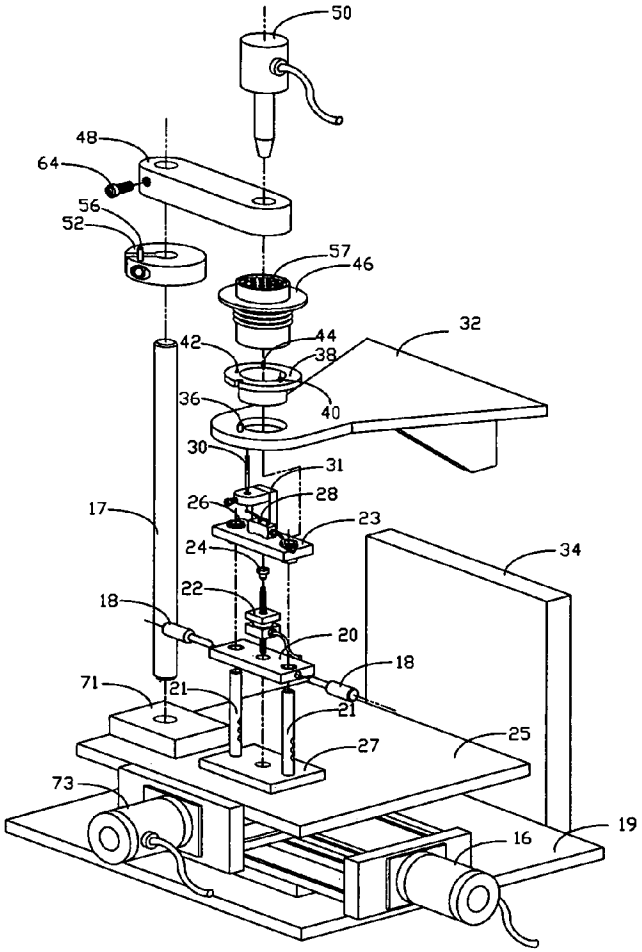
FIG. 2 is another perspective and exploded view of a preferred embodiment of present invention of a contact insertion and testing device.

FIG. 2 is another embodiment of this invention. Respectively it shows a three-dimensional and exploded view of the complete contact insertion device. All elements as labeled otherwise are referenced in FIG. 1.

Figure 3:
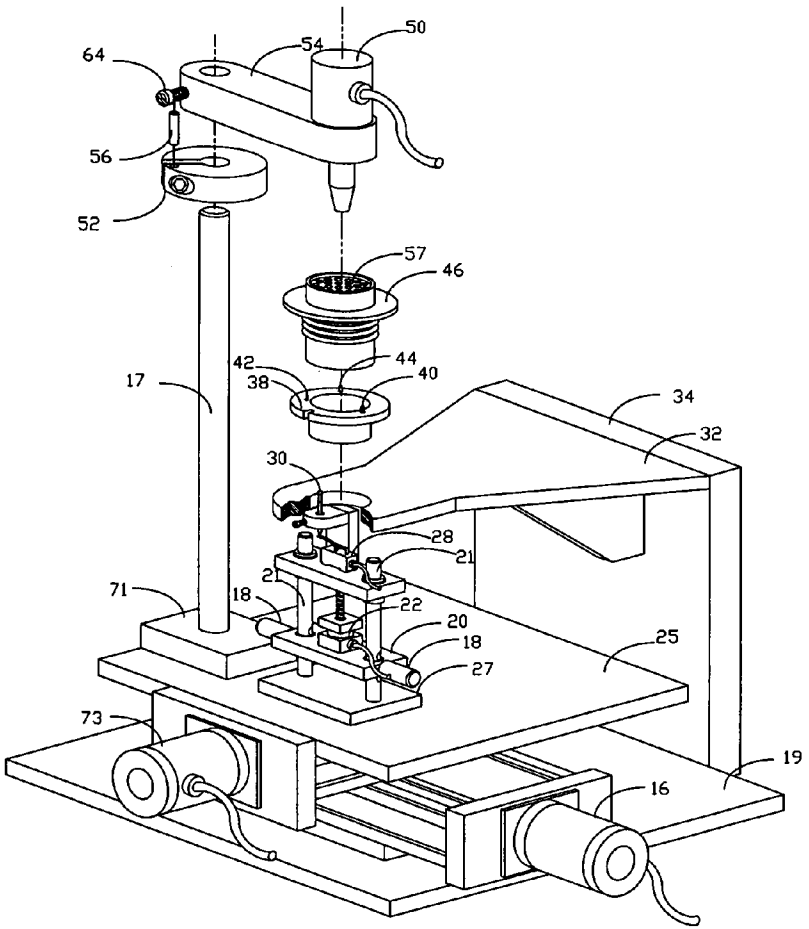
FIG. 3 is a perspective and exploded view of a preferred embodiment of present invention of a contact insertion and testing device with a sectional cutout view.

FIG. 3 is another perspective and exploded view of this invention including a cut away view of mounting bracket 32. This shows the relative position of test pin 30 in consideration to mounting bracket 32 and limit switch 28 and wiper blade 30A respectively. It also shows connector 46 and clocking insert 38 in an exploded view above mounting bracket 32. All elements as labeled otherwise are referenced in FIG. 1.

Figure 4:
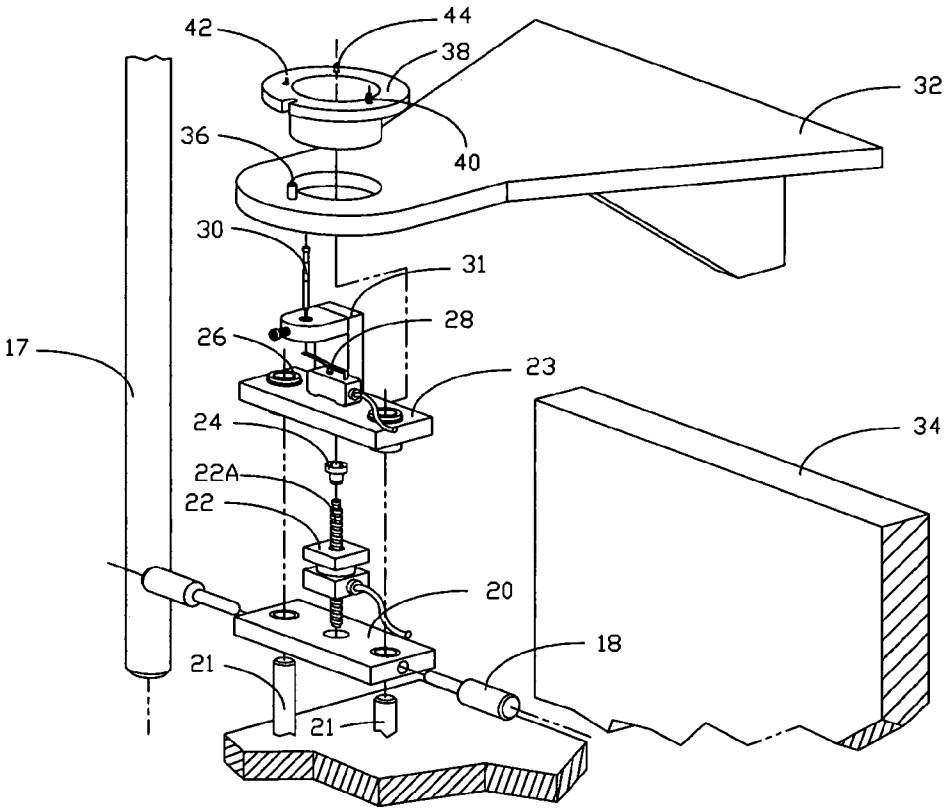
FIG. 4 is a partial perspective and exploded view of a preferred embodiment of present invention.

FIG. 4 is a perspective and exploded view of a portion of this invention. It shows more explicatively z-axis linear actuator 22 with lead screw 22A and thrust bearing 24. It also shows height adjustment pins 18 in relation to platform 20. The height adjustment pins 18 are interfacing with holes provided in plurality of bar 21 as such locking platform 20 in vertical plane. The purpose of aforesaid is to increase the work envelope of z-axis actuator 22. A hole provided in platform 20 provides clearance for lead screw extension of z-axis actuator 22 when in retracted position.

Figure 5:
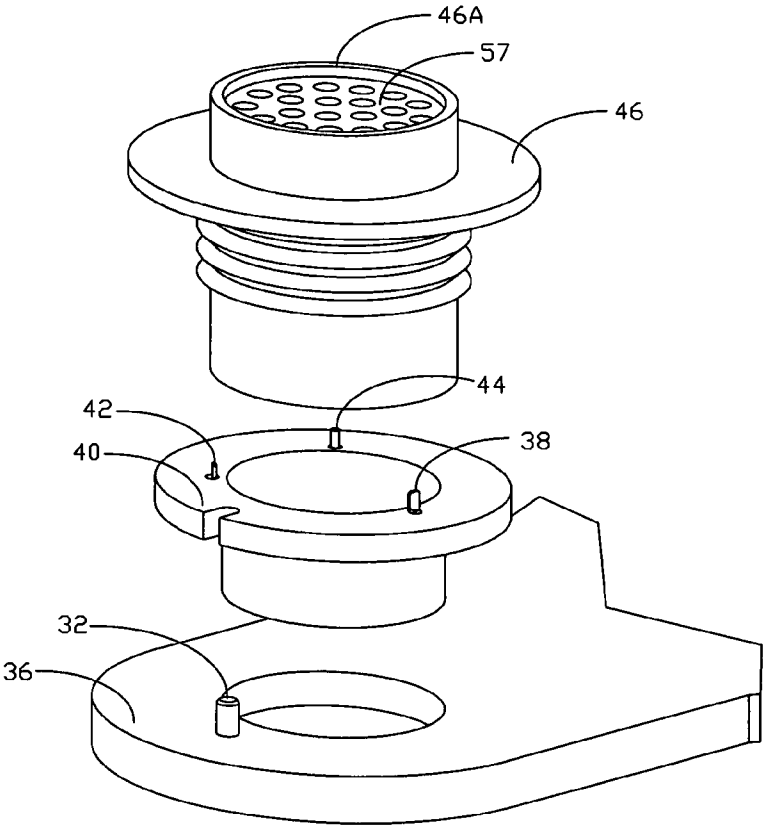
FIG. 5 is another partial and perspective and exploded view of a preferred embodiment of present invention.

FIG. 5 is a perspective expanded and enlarged view of a portion of the invention. It shows female connector 46 having insulator 57 with clocking insert 40 located and locked over locator pin 32 to assure that connector 46 is positioned properly meshing with clocking pin 38, 44, 42 with the connector 46 plurality of keyway—not shown—thereof located on inside diameter of outer shell 46A.

Figure 6:
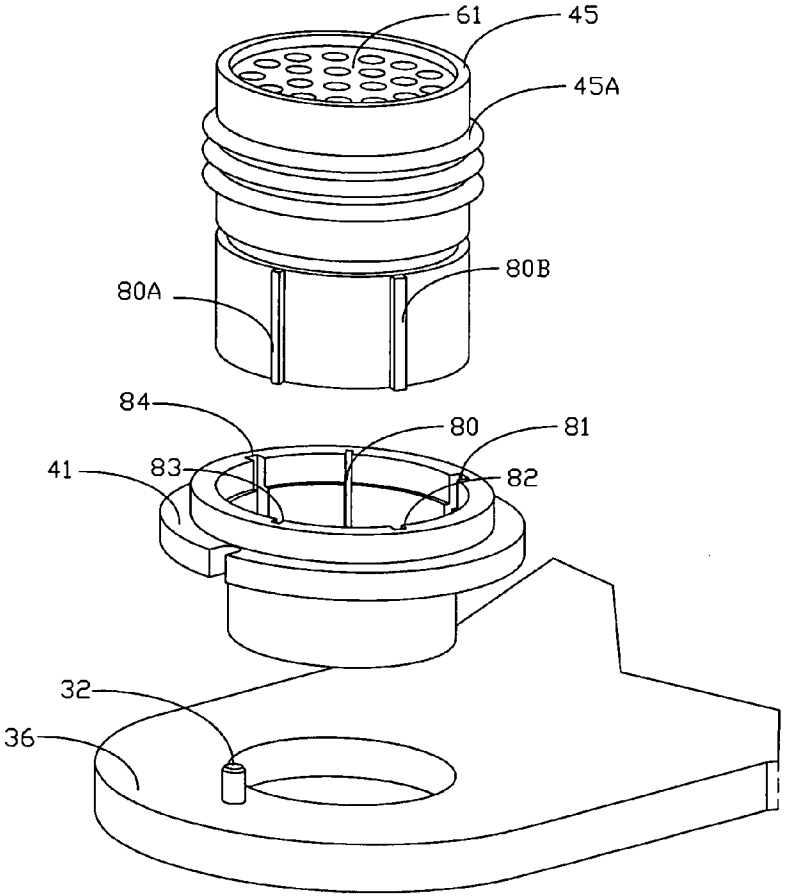
FIG. 6 is another partial and perspective and exploded view of a preferred embodiment of present invention.

FIG. 6 is another perspective expanded and enlarged view of a portion of the invention. It shows male connector 45 having insulator 61 with clocking insert 41 located and locked over locator pin 32 to assure that connector 45 is positioned properly meshing with clocking key way 80, 81, 82, 83, 84 with connector 45 having keyway 80A, 81A, 82A, 83A, 84A located on outside diameter of outer shell 45A.

Figure 7:
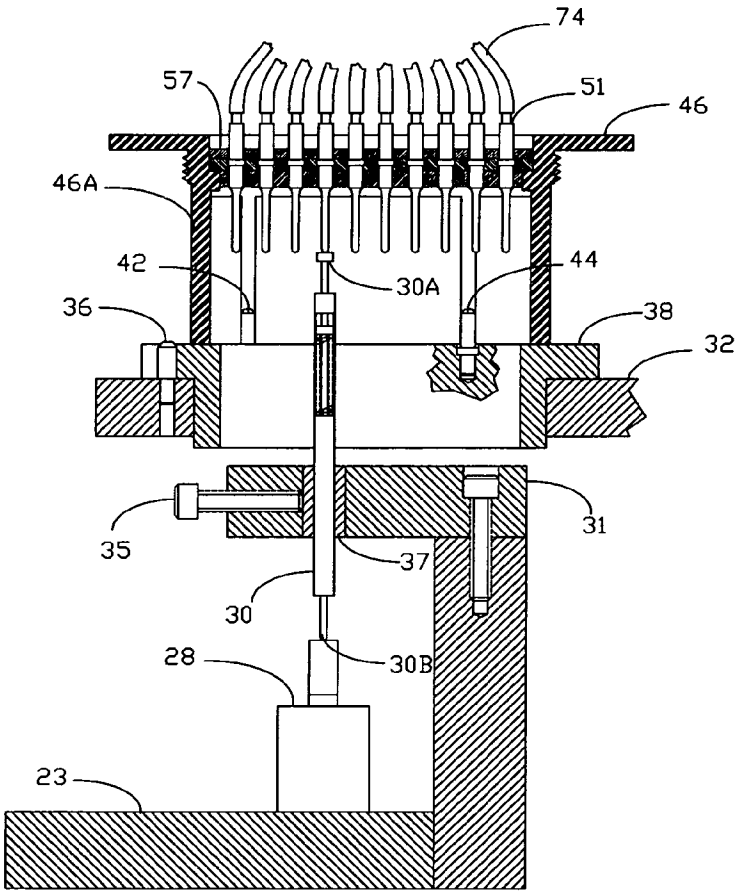
FIG. 7 is a cross sectional view of a preferred embodiment of present invention taken along lines 7-7 respectively in FIG. 1
Figure 14:
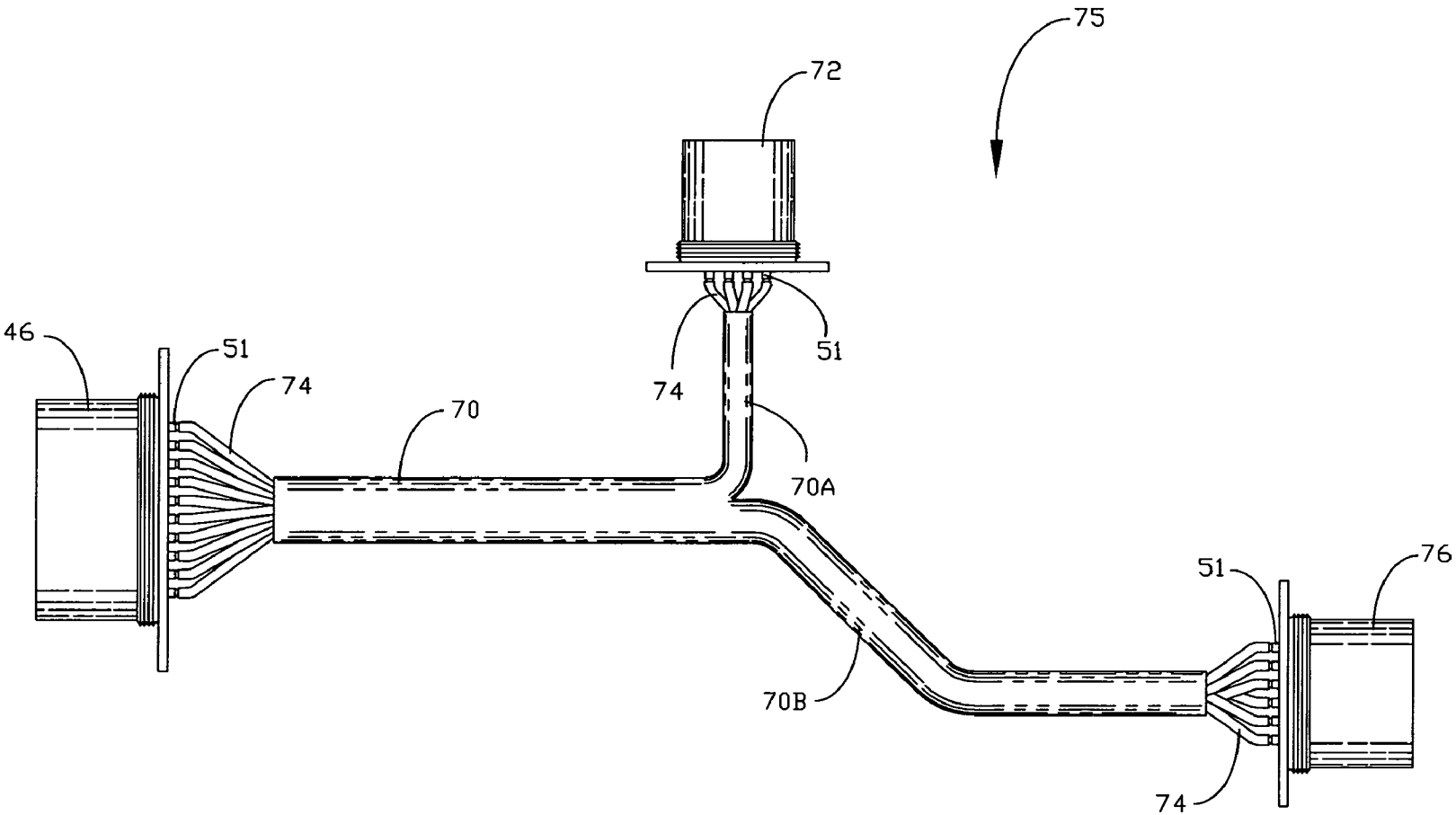
FIG. 14 is a plan view of a wire harness.

FIG. 7 is a cross section view of connector 46 with inserted plurality of contact 51 having wire 74—refer to FIG. 14—in plurality of cavity of insulator 57. Connector 46 rests atop of clocking insert 38. Locator pin 44 and 42 respectively is meshing with plurality of key way on inside diameter of connector shell 46A. Test pin 30 held by bushing 37 and setscrew 35 is in coaxial alignment with inserted contact 51. Tip thereof is pushing the tip 30A of test pin 30 downwardly causing the opposite end tip 30B thereof pushing wiper blade 30A of limit switch 28 to trigger an electrical signal. At that point contact 51 insertion process is complete.

Figure 8:
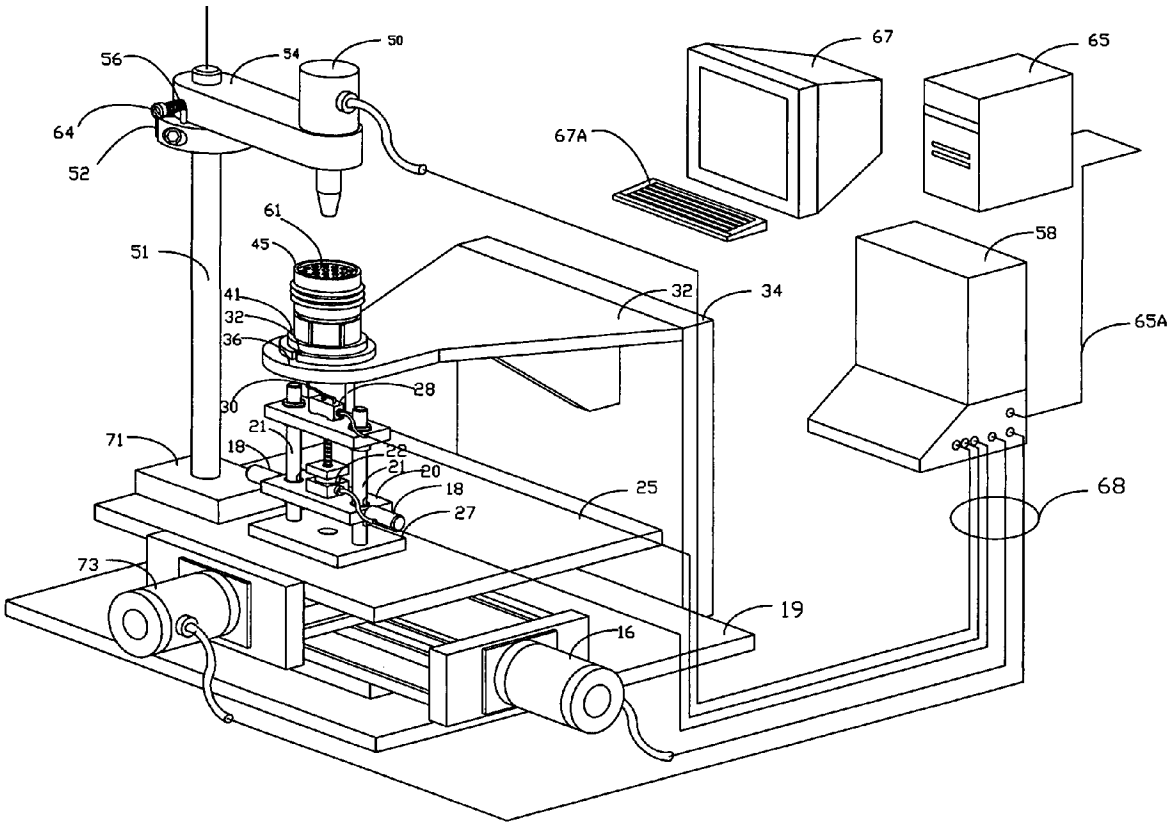
FIG. 8 is a perspective view of a preferred embodiment of present invention of a contact insertion and testing device showing peripheral control devices.

FIG. 8 is a perspective view of this invention. In retrospect it shows the final location of female connector 45 with clocking insert 41 in ready position for insertion process of plurality of contact 61. All elements as labeled otherwise are referenced in FIG. 1.

Figure 9:
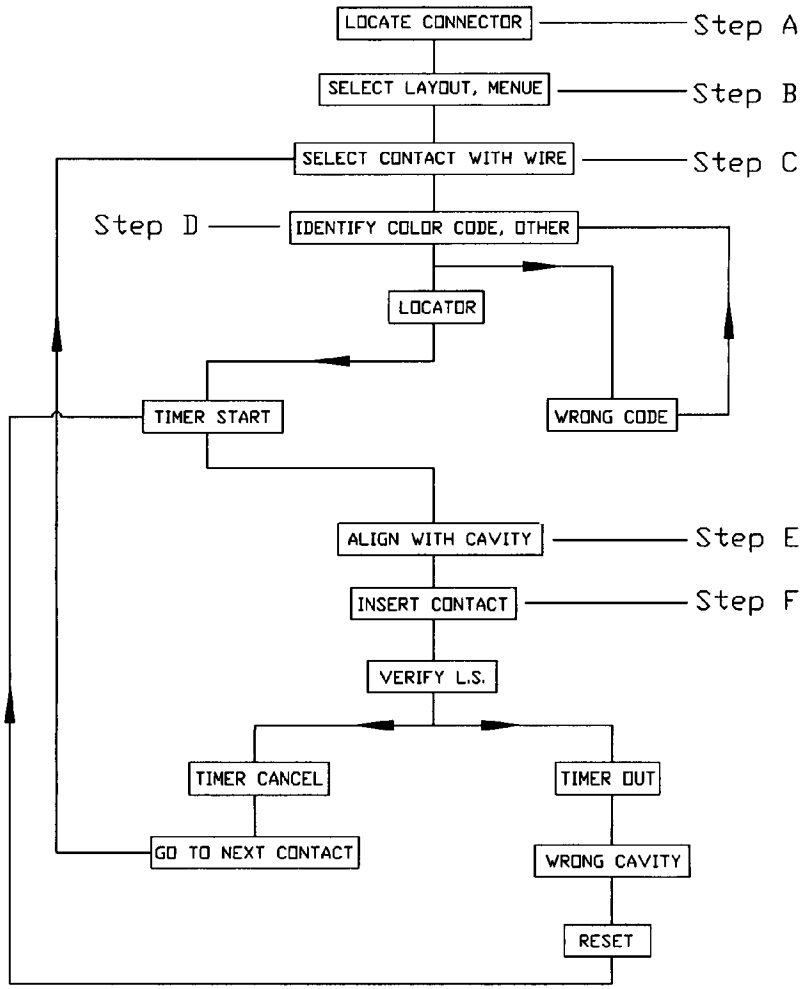
FIG. 9 is a process flow diagram of a preferred embodiment of present invention of a contact insertion and testing device.

FIG. 9 shows the process flow diagram of the contact insertion of this invention. Description of this process begins with Step A, locate connector. Referencing to FIG. 1 connector 46 is selected for insertion of contact 51 referencing to FIG. 7. Referencing to FIG. 7 insulator 57 with plurality of cavity arranged in number and position per an array called the layout. There are a great number of connector types each with insulator having differing layout from each other. Also there are a great number of types of contacts. A code or color band identifies each type of contact. The code is numeric and stamped onto contact 57 referencing to FIG. 7 or in retrospect the color band is painted onto the contact. In many cases a wire is connected to the contact. The connected wire has also a color marking. Each type of connector 46 referencing to FIG. 1 has an identification number printed on the outer diameter of connector shell 46A. This identification number determines also the type of layout for insulator 57 referencing to FIG. 7. Step B, Select Layout is the identification process for type of contact 51 referencing to FIG. 7 to match cavity location of insulator 57 referencing to FIG. 1. Step B means the display of a menu on touch screen display 67 of computer 65 referencing to FIG. 1. The menu is a touch screen type depicting code 74 embossed on contact 51 referencing FIG. 15 or color banding 76 painted on contact 51 referencing FIG. 14 or color marking 72 of wire 70 of contact 51 referencing on FIG. 14. Step C in retrospect is the selection of a contact subject to be inserted into insulator 51 referencing to FIG. 7. Step D is the identification of the marking such as stamped code 74 referenced on FIG. 15 or color band 76 of contact 51 referencing to FIG. 14. This can be done manually by reading the code or color band of contact 51 referencing to FIG. 14 and touching the comparable code or color code displayed on touch screen display 67 of computer 65 referencing to FIG. 1. In retrospect this will initiate the z-axis mounting plate 23 referencing to FIG. 1 with limit switch 28 referencing to FIG. 1 and test pin 30 referencing to FIG. 7 to adjust to correct height and position x-y positioner table 25 referencing to FIG. 1 into the appropriate assigned x-y coordinate. In retrospect of laser illuminated cavity of insulator 57 referencing to FIG. 1 is visual. Step E is the insertion with the in step D identified contacts 57 referencing to FIG. 1. Sub routines occurring in retrospect to completion of step D are for verification and corrective action. Specifically a timer activates for timing of the insertion process within an allotted time period. This is to assure that the previously identified contact 57 referencing to FIG. 1 is being inserted within allotted time delay thus guaranteeing that the proper contact will be in the proper cavity. In retrospect the plunger of test pin 57 referencing to FIG. 7 will be pushed down by the inserted contact 51 referencing to FIG. 7 thus causing the test pin 30 referencing to FIG. 7 opposing end to trigger wiper blade of limit switch 28 referencing to FIG. 7 to close the timer circuit once contact 51 referencing to FIG. 7 is properly inserted and thus canceling the timer. Once timing cycle has been cancelled within the specific time increment allowed it is verified that the correct contact 57 referencing to FIG. 7 has been inserted correctly into the correct cavity of insulator 51 referencing to FIG. 7. For corrective action misreading of code or color band will be flagged and corrected at the input level. In retrospect at step E the assigned x-y coordinate to x-y positioner table 25 referencing to FIG. 1 will match with a specific assigned contact code or color band of contact 51 referencing to FIG. 7 or color of wire attached to contact 51 referencing to FIG. 7. The now positioned x-y positioner table 25 referencing to FIG. 1 has been encoded to its coordinate accepting only the to this coordinate assigned contact 57 referencing to FIG. 1.

Figure 10:
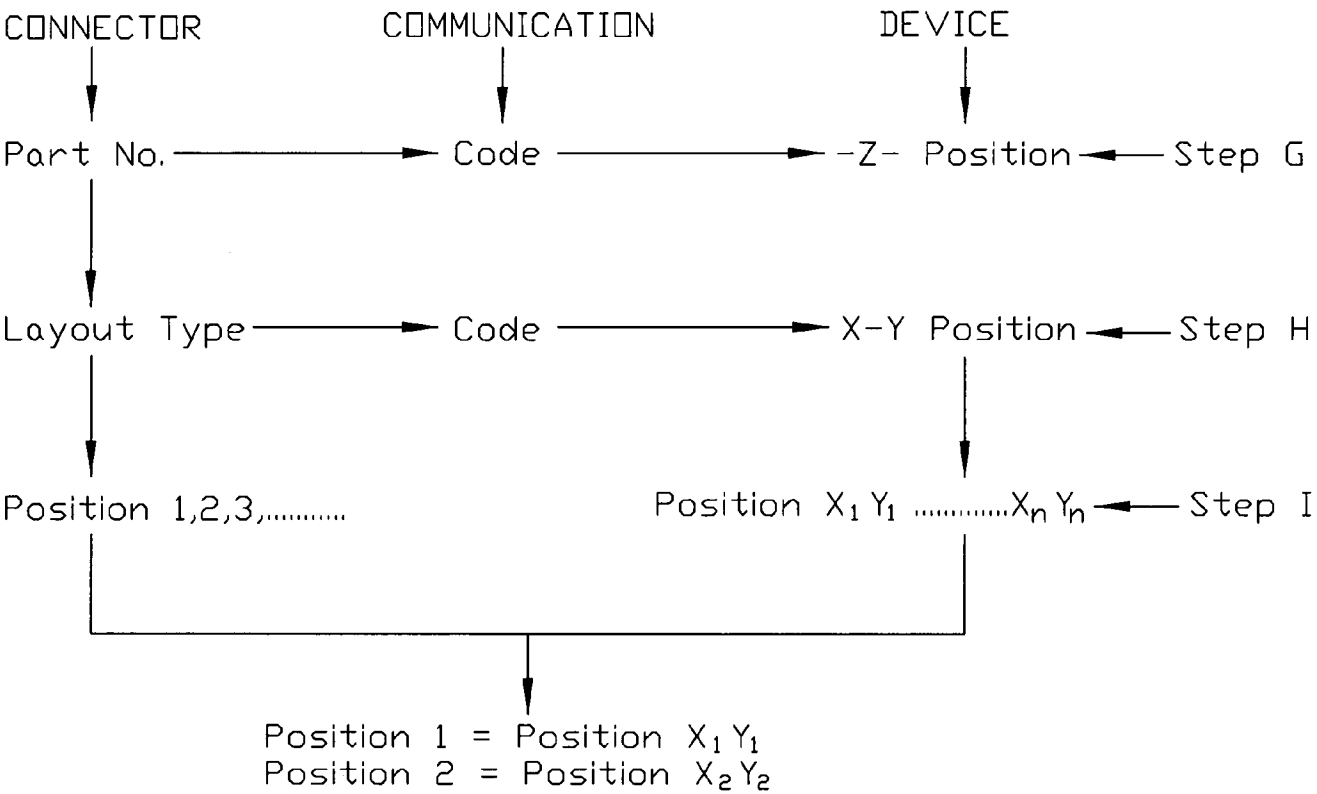
FIG. 10 is a signal communication hierarchy of a preferred embodiment of present invention of a contact insertion and testing device.

FIG. 10 is a matrix showing the protocol how the layout for cavity locations of insulator 57 referencing to FIG. 1 is communicated via controller 58 referencing to FIG. 1 to x-y positioning table 25 referencing to FIG. 1 and z axis actuator 22 referencing to FIG. 1. for matching cavity location of insulator 57 referencing to FIG. 1 for contact 51 referencing to FIG. 7. Step G is the input of part number for connector to be ready for contact insertion. Input device 65 referencing to FIG. 1 is a computer connected with controller 58 referencing to FIG. 1. The input part number will initiate the computer 65 referencing to FIG. 1 to down load via code the layout information to controller 58 referencing to FIG. 1 which in turn will initiate the z-axis actuator 22 referencing to FIG. 1 to position mounting plate 23 referencing to FIG. 1 into proper height or z-position. Step H is being implemented simultaneously to step G, the input part number will initiate the computer 65 referencing to FIG. 1 to down load via code the layout information to controller 58 referencing to FIG. 1 which in turn will initiate the x-y axis table positioner 25 referencing to FIG. 1 to recognize proper cavity locations in x-y coordinate according to layout for insulator 57 referencing to FIG. 1. Step I is the complete association for all cavity locations for insulator 57 referencing to FIG. 1 to contact 51 referencing to FIG. 7 for positioning of positioner table 25 referencing to FIG. 1 upon command for contact insertion.

Figure 12:
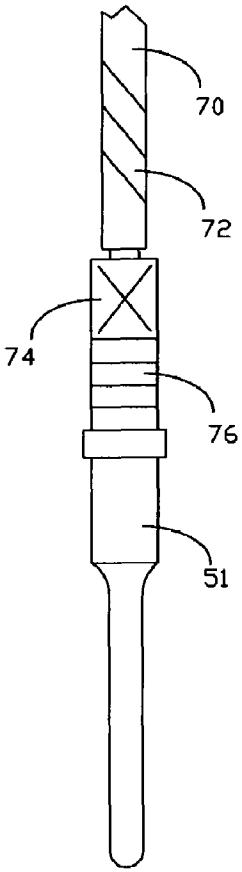
Fig. 12 (prior art)
FIG. 12 is a front elevation view of a contact

FIG. 12 is depicting contact 51 having 3-color band 76 and crimp area 74 for wire 70. On insulation of wire 70 color marking 72 is shown.

Figure 13:
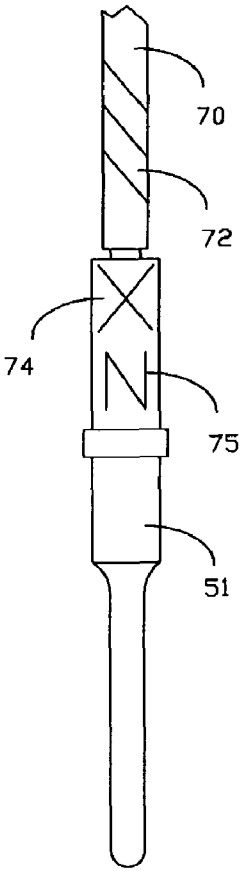
Fig. 13 (prior art)
FIG. 13 is a front elevation view of a further contact

Certain applications are using contacts wherewith the color marking may be substituted with a numeric code as is shown on FIG. 13 depicting contact 51 having embossed code 75 and crimp area 74 for wire 70. On insulation of wire 70 color marking 72 is shown.

Figure 11:
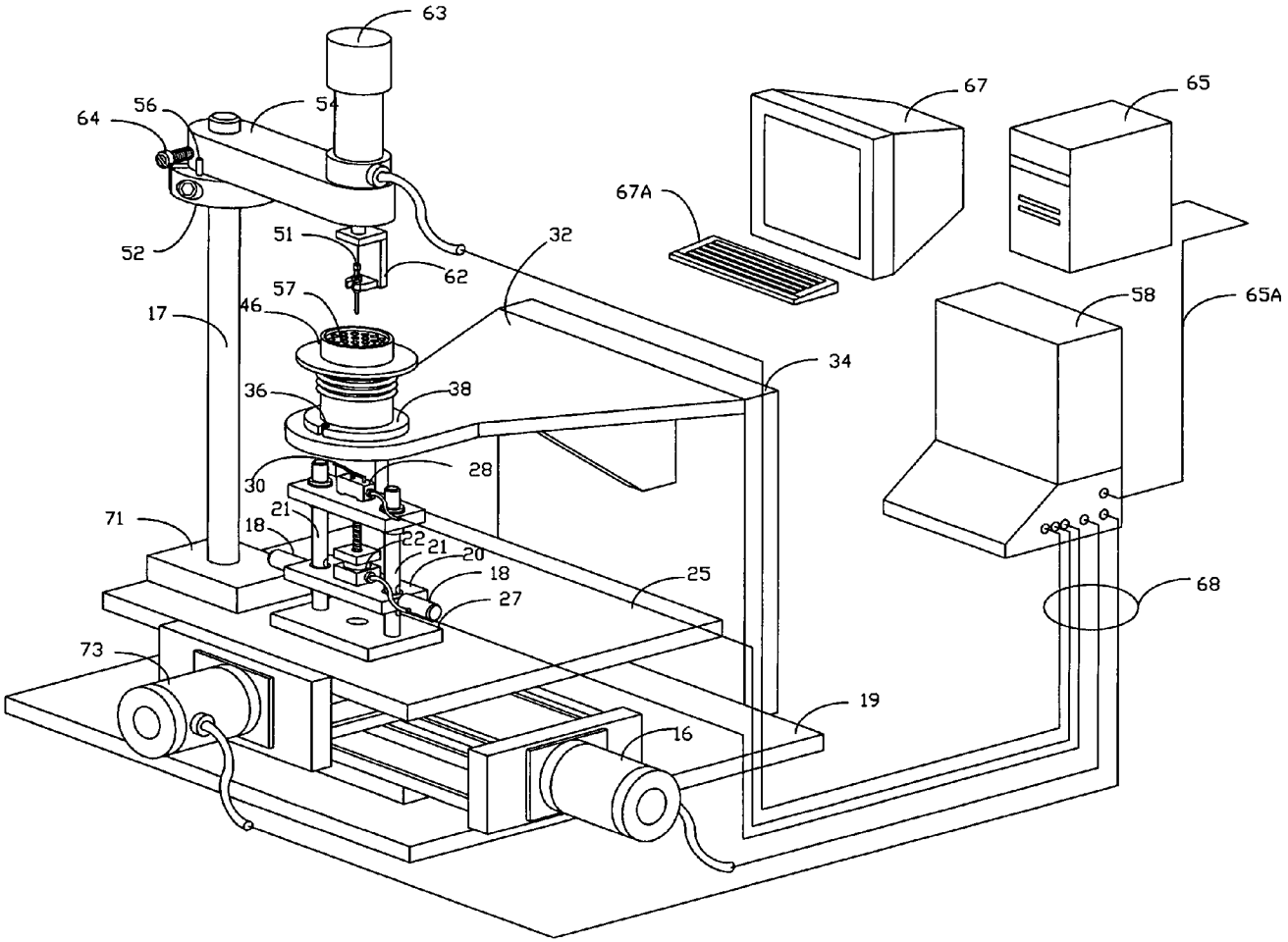
FIG. 11 (cancelled)

FIG. 14 Connectors are the termination elements of a wire harness assembly. Thereof is a combination of cables bundled together having said connector mating with an opposing connector for the purpose to transmit electric current to respective elements such as power supply, computer, control instrumentation and the like. FIG. 11 shows a common wire harness assembly 75. Connector 46, 74 and 76 respectively comprises outer body or shell 46A, 74A and 76A respectively thereof encircling insulator—not shown—having plurality of contact 51 inserted and locked into appropriate cavity of said insulator. Termination end of plurality of wire 72 attaches to opposing extremity of plurality of contact by means of crimp or solder connection. Plurality of wire 72 is bundled to combine cable 70 thereof branching off at junction 71 and forming cable 70A and 70B respectively with plurality of wire 72 terminating at opposite connector 74 and 76 and as such plurality of contact 51 respectively by means of crimped or soldered attachment to plurality of contact 51 that is inserted and locked in insulator cavity of connector 76 and 74 respectively.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element.

The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject mailer as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An apparatus for enunciation of a predetermined cavity location in an electrical connector insulator for the installation of a predetermined electrical conductor article into said cavity wherein said apparatus includes a verification arrangement with controller, sensor and computer for said enunciation of said cavity location and said verification arrangement said enunciation and verification apparatus comprising;

Enunciation means for identifying said cavity location as such to be recognized visually by means of a laser beam generator;

Predetermined said cavity location means thereof to be selected by means of a multi directional servo actuator prior to said enunciation;

Installation means insertion of said electric conductor into said cavity to a registration point in vertical plane thereof determined by means of single axis servo actuator;

Verification arrangement means identification of said electric conductor for verifying the presence thereof at said registration point and confirm completion of said insertion of said electric conductor into said insulator cavity;

Predetermined said electrical conductor means thereof to be selected by means of manual input or a scanning device and said electric conductor to be presented to said enunciated cavity in collinear fashion ready for said insertion;

Sensor means for verifying presence of said electric conductor in said insulator cavity;

Electric connector means outer shell having said insulator.

2. The apparatus of claim 1 comprises said enunciation apparatus wherein said enunciation means a laser beam generator positioned collinear above upper extremity of said insulator.

3. The apparatus of claim 2 comprises said enunciation apparatus wherein said laser beam generator comprises an optical arrangement for focusing a laser beam onto said cavity location.

4. The apparatus of claim 1 comprises said enunciation apparatus wherein said laser beam generator moves across said upper extremity of said insulator by means of multi axis actuator thereof having a platform upon thereof said laser beam generator is affixed to.

5. The apparatus of claim 4 comprises said enunciation apparatus wherein said multi axis actuator has input by means of a controller thereof initiating and controlling movement of said multi axis generator to said cavity location.

6. The apparatus of claim 5 comprises said enunciation apparatus wherein said controller has input by means of a computer thereof enabling said controller to initiate movement of said multi axis generator.

7. The apparatus of claim 1 comprises said enunciation apparatus wherein said verification comprises a test pin contact positioned and stationary in collinear fashion with said laser beam generator below lower extremity of said insulator and said test pin contact having spring loaded center piece with lower extremity thereof to be adjacent in perpendicular fashion opposing said sensor having wiper blade wherein said test pin is located in stationary position in vertical plane allowing said center piece lower extremity to urge against said wiper blade.

8. The apparatus of claim 7 comprises said enunciation apparatus wherein said test pin contact with said sensor moves in vertical plane by means of said single axis actuator having a platform thereof said test pin with said sensor is affixed upon.

9. The apparatus of claim 8 comprises said enunciation apparatus wherein said single axis actuator has input by means of said controller thereof initiating and controlling movement of said single axis actuator.

10. The apparatus of claim 9 comprises said enunciation apparatus wherein said controller has input by means of a computer thereof enabling said controller to initiate movement of said single axis actuator wherein said electrical conductor urges against upper extremity of said inner piece of said test pin resulting lower extremity thereof to urge against said wiper blade of said limit switch thus resulting in said limit switch to transmit a signal to said controller for arresting said single axis actuator movement.

11. The apparatus of claim 10 comprises said enunciation apparatus wherein said arrest of movement of said single axis actuator determines said reference point of said electrical conductor thus presence and completion of said insertion into said cavity.

12. The apparatus of claim 1 comprises said enunciation apparatus wherein said completion of said insertion of said electrical conductor is conditional upon prior verification of said electrical conductor by means of scanner or manual input.

13. The apparatus of claim 1 comprises said enunciation apparatus wherein said computer has a program for instructing said controller to select said cavity location for the insertion of said electric conductor.

14. The apparatus of claim 1 comprises said enunciation apparatus wherein said computer has a program for instructing said controller to enunciate said insertion of said electric conductor in error by means of audible or visual signal meaning that input from said scanner of said electric conductor or said manual input of said electric conductor is not matching said cavity location with said electric conductor to per said program executed by said computer.

15. The apparatus of claim 1 comprises said enunciation apparatus wherein said electric connector is fixated in stationary position by means of locator insert as such providing proper orientation of said electric connector in horizontal plane for insertion of said plurality of electric conductor into said plurality of cavity in said insulator.

16. The apparatus of claim 1 comprises said enunciation apparatus wherein said electric connector is fixated in stationary position as such to be sandwiched between upper said laser beam generator and lower said test pin arrangement.

* * * * *